US011419190B2

(12) United States Patent
Durnan

(10) Patent No.: US 11,419,190 B2
(45) Date of Patent: Aug. 16, 2022

(54) RF HEATING APPARATUS WITH RE-RADIATORS

(71) Applicant: NXP USA, Inc., Austin, TX (US)

(72) Inventor: Gregory J. Durnan, Tempe, AZ (US)

(73) Assignee: NXP USA, Inc., Austin, TX (US)

( * ) Notice: Subject to any disclaimer, the term of this patent is extended or adjusted under 35 U.S.C. 154(b) by 595 days.

(21) Appl. No.: 16/359,900

(22) Filed: Mar. 20, 2019

(65) Prior Publication Data

US 2020/0305244 A1 Sep. 24, 2020

(51) Int. Cl.
*H05B 6/68* (2006.01)
*H05B 6/72* (2006.01)
*H05B 6/70* (2006.01)

(52) U.S. Cl.
CPC ..... *H05B 6/687* (2013.01); *H05B 6/705* (2013.01); *H05B 6/72* (2013.01)

(58) Field of Classification Search
CPC ..... H05B 6/687; H05B 6/70; H05B 6/705; H05B 6/72
USPC ..... 219/715, 702, 746, 750, 756, 761, 660, 219/678, 695, 553
See application file for complete search history.

(56) References Cited

U.S. PATENT DOCUMENTS 2,790,054 A 4/1957 Haagensen
3,271,552 A 9/1966 Krajewski
3,843,863 A 10/1974 Fitzmayer
4,431,888 A 2/1984 Simpson
4,870,233 A 9/1989 McDonald et al.
8,228,193 B1 * 7/2012 Turner ..... G06K 19/0723 342/51
2004/0004074 A1 1/2004 Torngren et al.
2011/0108548 A1 5/2011 Nobue et al.
2013/0206749 A1 8/2013 Libman et al.
2015/0136760 A1 * 5/2015 Lima ..... H05B 6/686 219/709

FOREIGN PATENT DOCUMENTS

WO WO-2019038941 A1 * 2/2019 ..... F24C 7/02

* cited by examiner

*Primary Examiner* — Quang T Van

(57) ABSTRACT

A thermal increase system may include re-radiators disposed in a cavity for containing a load. Microwave energy may be generated by one or more microwave generation modules, and directed toward the cavity during operation of the thermal increase system, thereby creating an electromagnetic field in the cavity. A system controller may control switches coupled between the re-radiators and corresponding ground nodes to selectively activate and de-activate the re-radiators. The system controller may control a switch coupled between a pair of re-radiators to re-distribute the electromagnetic field in the cavity. A phase shifter may be disposed between a pair of re-radiators, which may provide a phase shift to energy passed between the re-radiators. The phase shifter may be a variable shifter that applies a variable phase shift to the energy according to commands received from the system controller.

14 Claims, 6 Drawing Sheets

RF HEATING APPARATUS WITH RE-RADIATORS

TECHNICAL FIELD

Embodiments of the subject matter described herein relate generally to apparatus and methods of heating and/or heating a load using microwave and radio frequency (RF) energy.

BACKGROUND

Field uniformity, and therefore heating uniformity in a work load, is one of the grand challenges of microwave and radio frequency (RF) heating. An electromagnetic wave can propagate within a cavity in a number of different modes. These modes include: 1) TE mode, in which the transverse electric waves (H waves) are characterized by the electric vector (E) being perpendicular to the direction of propagation; 2) TM mode, in which transverse magnetic waves (E waves) are characterized by the magnetic vector (H vector) being perpendicular to the direction of propagation; and 3) TEM mode, in which both the electric vector (E vector) and the magnetic vector (H vector) are perpendicular to the direction of propagation.

The field distribution in a resonant cavity (e.g., a microwave cooking cavity) depends on the number of modes that can be excited within a cavity. In practice though, only one mode may be excited at a single point in time, such that over a cooking cycle it is necessary to assign individual time slots for the mode being excited. Several strategies have been employed to excite multiple modes or disturb the dominant mode structure over the cooking period (e.g., using time slices or multiplexing over time of modes of interest), including turntables, mode stirrers and multiple waveguide feeds. Most of these strategies are frustrated by the lack of frequency and phase control associated with magnetron sources.

Many microwave packaged foods now come with "susceptors," which consist of a conductive (usually resistive) material painted or otherwise located on the food box, and which absorb electromagnetic energy and convert it to convective heat in order to provide browning. For example, a susceptor disk may be included on the inside top of a pie box in order to brown the surface of the pie, when the pie is microwaved.

Although some solutions, such as including susceptors in food packaging, may improve the quality of uniform cooking to a certain extent, conventional methods are sub-optimal. Accordingly, what are needed are methods and apparatus to more evenly heat loads within a microwave oven system.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
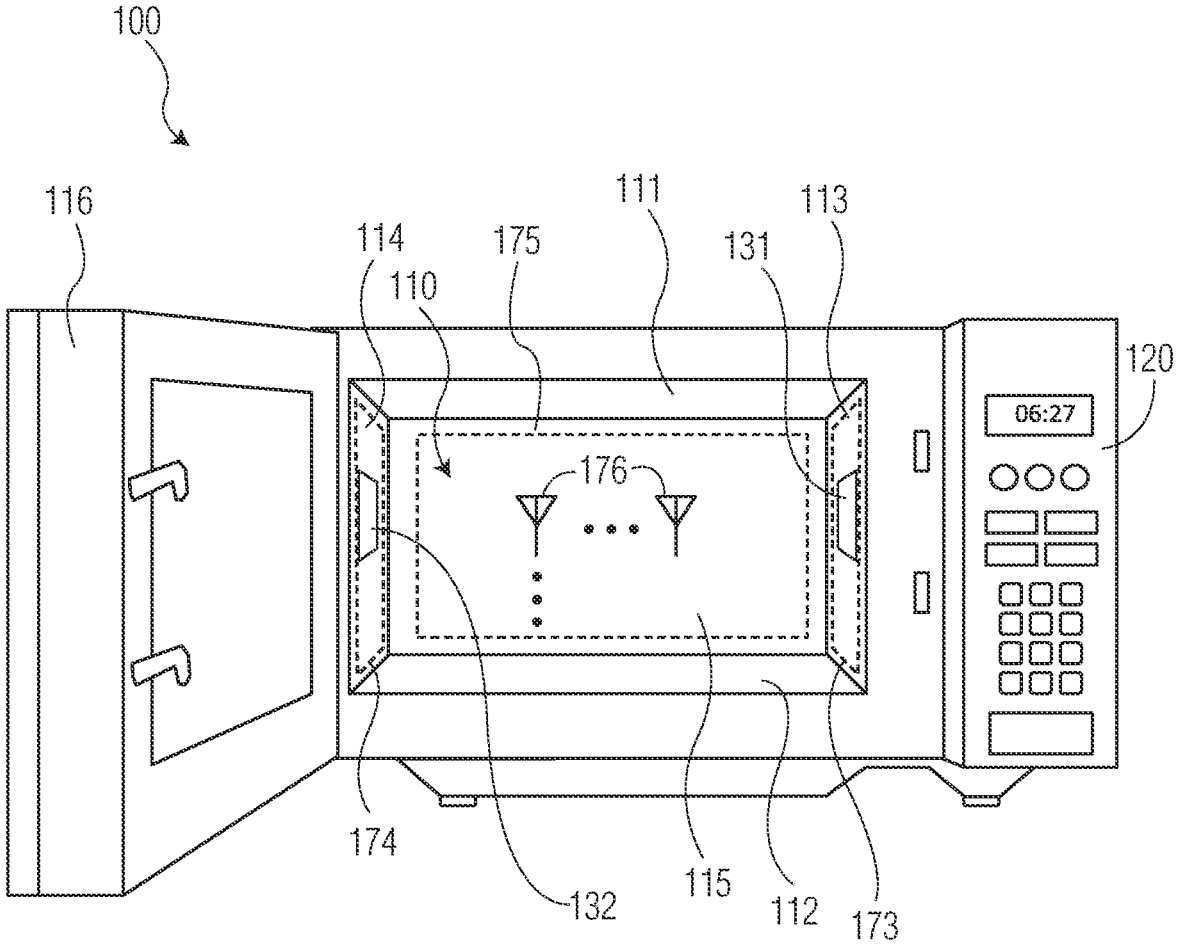
FIG. 1 is a perspective view of a heating appliance, in accordance with an example embodiment.

The following detailed description is merely illustrative in nature and is not intended to limit the embodiments of the subject matter or the application and uses of such embodiments. As used herein, the words "exemplary" and "example" mean "serving as an example, instance, or illustration." Any implementation described herein as exemplary or an example is not necessarily to be construed as preferred or advantageous over other implementations. Furthermore, there is no intention to be bound by any expressed or implied theory presented in the preceding technical field, background, or the following detailed description.

Embodiments of the subject matter described herein relate to solid-state heating apparatus that may be incorporated into stand-alone appliances or into other systems. Generally, the term "heating" means to elevate the temperature of a load (e.g., a food load or other type of load) to a higher temperature. As used herein, the term "heating" more broadly means a process by which the thermal energy or temperature of a load (e.g., a food load or other type of load) is increased through provision of RF power to the load. Accordingly, in various embodiments, a "heating operation" may be performed on a load with any initial temperature, and the heating operation may be ceased at any final temperature that is higher than the initial temperature. That said, the "heating operations" and "heating systems" described herein alternatively may be referred to as "thermal increase operations" and "thermal increase systems."

The electric field distribution within a heating cavity of a microwave heating system or other RF heating system during heating operations (e.g., when microwave electromagnetic energy is injected into the heating cavity through a waveguide or other resonant element) may be non-uniform, with some locations within the heating cavity receiving more electromagnetic energy than average, and other locations receiving very little electromagnetic energy or none at all. Areas with higher peak electric field magnitudes may result in "hot spots" in portions of a heated load at those areas. Areas with low or no peak electric field magnitudes may result in "cold spots" in portions of a heated load at those areas.

According to various embodiments, redistribution and/or random scattering of electromagnetic energy within the heating cavity (e.g., using re-radiators disposed in the heating cavity) may help to smooth the electric field distribution within the heating cavity, allowing a load within the heating cavity to be heated more evenly. Re-radiator placement within the heating cavity may be customized according to the characterization of a particular heating system. Alternatively, a programmable array of re-radiators may be included in the heating cavity, which includes connections between pairs of re-radiators of the array and/or between the re-radiators of the array and ground that may be selectively enabled and disabled by controlling one or more switches. The programmable array of re-radiators is not necessarily in a pre-designed arrangement for electric field redistribution and/or random scattering in one particular heating system with a specific set of characteristics and corresponding electric field distribution, but may instead be reconfigured to provide electric field redistribution and/or random scattering for a variety of heating systems with a variety of characteristics and corresponding electric field distributions.

FIG. 1 is a perspective view of a heating system 100, in accordance with an example embodiment. Heating system 100 includes a heating cavity 110, a control panel 120, one or more microwave power generation modules 131, 132, a power supply (e.g., power supply 230, FIG. 2), and a system controller (e.g., system controller 210, FIG. 2). The heating cavity 110 is defined by interior surfaces of top, bottom, side, and back cavity walls 111, 112, 113, 114, 115 and an interior surface of door 116. With door 116 closed, the heating cavity 110 defines an enclosed air cavity. As used herein, the term "air cavity" may mean an enclosed area or volume that contains air or other gasses (e.g., heating cavity 110).

According to an embodiment, each of the microwave power generation modules 131, 132 is arranged proximate to one of cavity walls 113, 114. During operation of the heating system 100, a user (not illustrated) may place one or more objects (e.g., food and/or liquids) into the heating cavity 110, and may provide inputs via the control panel 120 that specify a desired heating duration and a desired power level. In response, a system controller (not illustrated) causes the microwave power generation modules 131, 132 to radiate electromagnetic energy in the microwave spectrum (referred to herein as "microwave energy") into the heating cavity 110. More specifically, the system controller causes the microwave power generation modules 131, 132 to radiate microwave energy into the heating cavity 110 for a period of time and at one or more power levels that are consistent with the user inputs. The microwave energy increases the thermal energy of the object (i.e., the microwave energy causes the object to heat up).

In the embodiment illustrated in FIG. 1, a microwave power generation module 131, 132 is arranged proximate to each of multiple cavity walls 113, 114. In alternate embodiments, more or fewer microwave power generation modules may be present in the system, including as few as one microwave power generation module proximate to a single cavity wall or to door 116. In other alternate embodiments, multiple microwave power generation modules may be proximate to any given cavity wall and/or to door 116.

One or more re-radiators 176 may be included at (e.g., on or proximate to) one or more of the side walls 113, 114, and 115, in regions 173, 174, and 175. Additionally or alternatively, one or more re-radiators 176 may be included at either or both of the top and/or bottom walls 111, 112, and/or on an interior of door 116. As used herein, a "re-radiator" refers to an antenna that absorbs electromagnetic energy that impinges on the antenna (e.g., electromagnetic energy emitted by one or more of the microwave power generation modules 131, 132) and then re-radiates that electromagnetic energy, generally with a different phase from other re-radiators of the system 100. Re-radiators are passive radiators, in an embodiment, in contrast with active radiators that are driven by a direct connection to a power supply or transmitter. The re-radiators 176 may include one or a combination of dipole antennas, monopole antennas, patch antennas, loop antennas, and hairpin antennas, for example.

As an example, the heating system 100 may be characterized (e.g., using electromagnetic simulation and modeling) to identify areas of electric field non-uniformity in the heating cavity 110 during the heating of a load. The re-radiators 176 may be selectively placed at positions at (e.g., on or proximate to) the walls 113, 114, and 115 that are expected to correspond to higher than average and lower than average peak electric field magnitudes based on the characterization of the heating system 100.

For example, if the re-radiators 176 include patch antennas, the patch antennas may be disposed on the walls 113, 114, and/or 115. As another example, if the re-radiators 176 include monopole or dipole antennas, the monopole or dipole antennas may include antenna elements that are proximate to the walls 113, 114, and/or 115, but that may not be considered to be directly "on" the corresponding wall(s). Dielectric material may be disposed between the re-radiators 176 and the wall(s) at which they are disposed to provide electrical insulation. One or more insulated through-holes may be included in the walls 113, 114, and/or 115, and conductors of the re-radiators 176 may pass through these through-holes to connect to circuitry (e.g., the switching circuitry shown in FIG. 3) outside of the cavity 110, for example. Alternatively, the re-radiators 176 may be arranged in one-dimensional (1D) or two-dimensional (2D) arrays in one or more of the regions 173, 174, and/or 175 positioned irrespective of electric field characterization of the heating system 100.

Each re-radiator 176 may be selectively activated (e.g., disconnected from ground) or deactivated (e.g., connected to ground) by controlling switches coupled between each re-radiator 176 and one or more ground terminals. Additional switches may be coupled in transmission paths between each of the re-radiators 176, such that each re-radiator 176 may be selectively connected to or disconnected from any given one or more of the other re-radiators 176. For example, a first re-radiator that is located in a first region associated with high peak electric field magnitude may be selectively connected to a second re-radiator that is located in a second region associated with low peak electric field magnitude so that electro-magnetic energy absorbed by the first re-radiator may be re-radiated by both the first and second re-radiators. This may significantly reduce the disparity between the peak electric field magnitudes at the first and second regions. In some embodiments, a phase shifter (e.g., phase shifter 306, FIG. 3) may be coupled between two connected re-radiators of the re-radiators 176, such that the phases of the RF signals emitted by the two connected re-radiators are shifted with respect to one another by a predetermined amount or, for embodiments in which the phase shifter is a variable phase shifter, by a selected amount. In some embodiments, the re-radiators 176 may selectively operate in a random scattering mode in which each of the re-radiators 176 is disconnected from ground and from each of the other re-radiators 176. The random scattering mode may improve electric field coverage within the cavity 110 without selectively targeting any particular region for re-radiation.

Each microwave power generation module 131, 132 is configured to produce and radiate microwave energy into the heating cavity 110, which introduces an electric field in the cavity 110. The radiated energy has a wavelength in the microwave spectrum that is particularly suitable for heating liquid and solid objects (e.g., liquids and food). For example, each microwave power generation module 131, 132 may be configured to radiate microwave energy having a frequency in a range of about 2.0 gigahertz (GHz) to about 3.0 GHz into the heating cavity 110. More specifically, each microwave power generation module 131, 132 may be configured to radiate microwave energy having a wavelength of about 2.45 GHz into the heating cavity 110, in an embodiment. Although each microwave power generation module 131, 132 may radiate microwave energy of approximately the same wavelength, the microwave power generation modules 131, 132 may radiate microwave energy of different wavelengths from each other, as well. Further, in embodiments of other systems (e.g., radar systems, communication systems, and so on) that include embodiments of microwave power generation modules, each microwave power generation module 131, 132 may radiate microwave energy within a relatively wide bandwidth (e.g., a bandwidth anywhere within the microwave spectrum of about 800 megahertz (MHz) to about 300 GHz).

As will be described in further detail below, each microwave power generation module 131, 132 may be implemented as an integrated "solid state" module, in that each microwave power generation module 131, 132 includes a solid state circuit configuration to generate and radiate microwave energy rather than including a magnetron, as is typical in a conventional microwave oven. Accordingly, embodiments of systems in which embodiments of microwave power generation modules are included may operate at relatively lower voltages, may be less susceptible to output power degradation over time, and/or may be relatively compact, when compared with conventional magnetron-based microwave systems.

The heating system 100 of FIG. 1 is embodied as a counter-top type of appliance. Alternatively, components of a heating system may be incorporated into other types of systems or appliances. Accordingly, the above-described implementation of a heating system in a stand-alone appliance is not meant to limit use of the embodiments only to those types of systems.

Although heating system 100 is shown with its components in particular relative orientations with respect to one another, it should be understood that the various components may be oriented differently, as well. In addition, the physical configurations of the various components may be different. For example, control panel 120 may have more, fewer, or different user interface elements, and/or the user interface elements may be differently arranged. In addition, although a substantially cubic heating cavity 110 is illustrated in FIG. 1, it should be understood that a heating cavity may have a different shape, in other embodiments (e.g., cylindrical, and so on). Further, heating system 100 may include additional components (e.g., a fan, a stationary or rotating plate, a tray, an electrical cord, and so on) that are not specifically depicted in FIG. 1.

Figure 2:
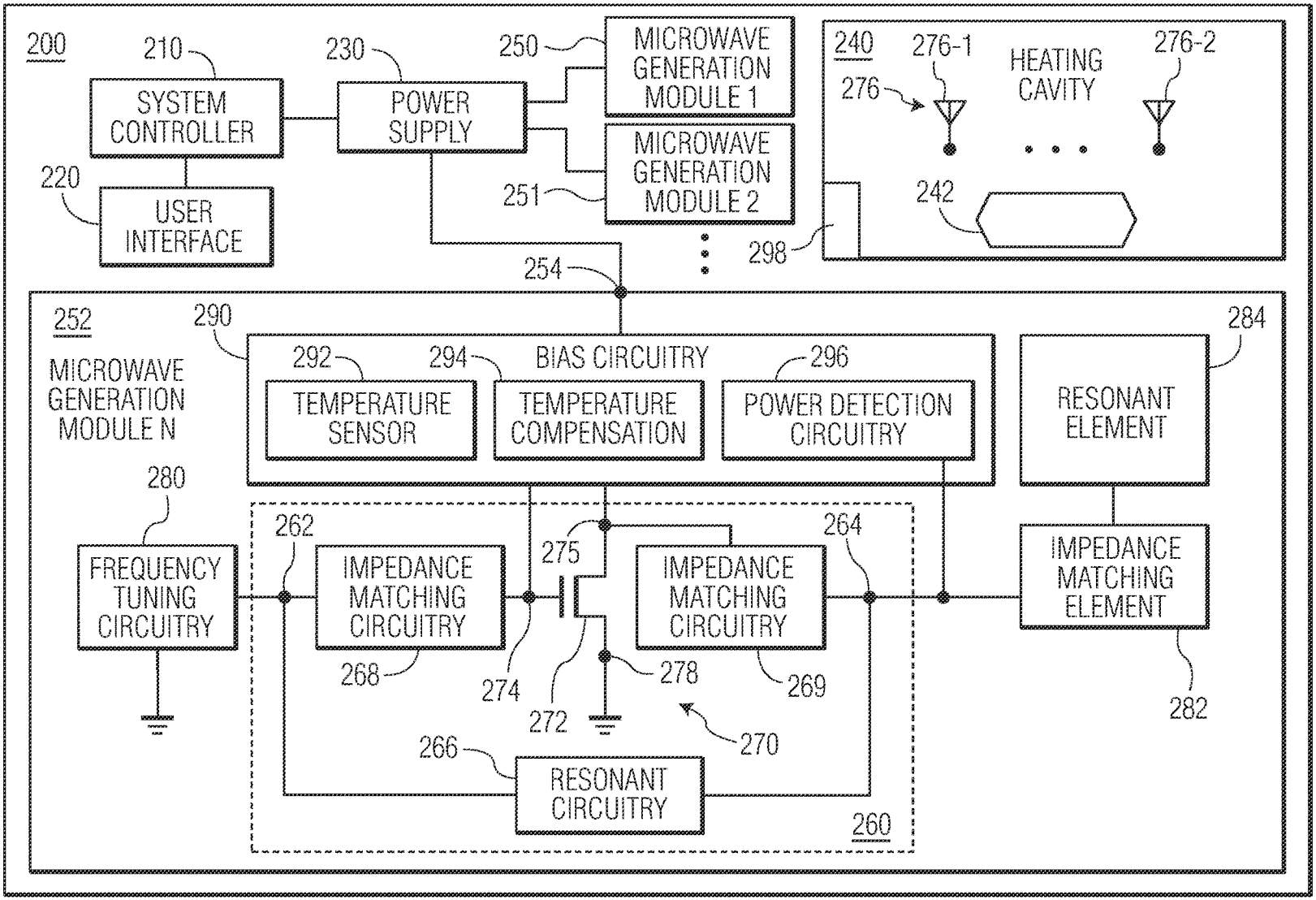
FIG. 2 is a simplified block diagram of a heating apparatus, in accordance with an example embodiment.

FIG. 2 is a simplified block diagram of a heating system 200 (e.g., heating system 100, FIG. 1) that includes multiple microwave power generation modules 250, 251, 252, in accordance with an example embodiment. In various embodiments, heating system 200 may include from 1 to N microwave power generation modules 250-252, where N can be any integer (e.g., an integer from 1 to 20). In addition, heating system 200 includes system controller 210, user interface 220, power supply 230, heating cavity 240, and re-radiators 276 (e.g., re-radiators 176, 376-1, 376-2, 576-1, 576-2, 676-1, 676-2, 676-3, 676-4, FIGS. 1, 3, 5A-5C, 6A, 6B) that include at least a first re-radiator 276-1 and a second re-radiator 276-2. It should be understood that FIG. 2 is a simplified representation of a heating system 200 for purposes of explanation and ease of description, and that practical embodiments may include other devices and components to provide additional functions and features, and/or the heating system 200 may be part of a much larger electrical system.

User interface 220 may correspond to a control panel (e.g., control panel 120, FIG. 1), for example, which enables a user to provide inputs to the system regarding parameters for a heating operation (e.g., the duration of a heating operation, the power level for a heating operation, codes that correlate with particular heating operation parameters, and so on), start and cancel buttons, mechanical controls (e.g., a door latch), and so on. In addition, the user interface may be configured to provide user-perceptible outputs indicating the status of a heating operation (e.g., a countdown timer, audible tones indicating completion of the heating operation, and so on) and other information.

System controller 210 is coupled to user interface 220 and to power supply 230. For example, system controller 210 may include a one or more general purpose or special purpose processors (e.g., a microprocessor, microcontroller, Application Specific Integrated Circuit (ASIC), and so on), volatile and/or non-volatile memory (e.g., Random Access Memory (RAM), Read Only Memory (ROM), flash, various registers, and so on), one or more communication busses, and other components. According to an embodiment, system controller 210 is configured to receive signals indicating user inputs received via user interface 220, and to cause power supply 230 to provide power to microwave power generation modules 250-252 for time durations and at power levels that correspond to the received user inputs.

Power supply 230 may selectively provide a supply voltage to each microwave power generation module 250-252 in accordance with control signals received from system controller 210. When supplied with an appropriate supply voltage from power supply 230, each microwave power generation module 250-252 will produce microwave energy, which is radiated into heating cavity 240. As mentioned previously, heating cavity 240 defines an air cavity. The air cavity and any objects (e.g., food, liquids, and so on) positioned in the heating cavity 240 correspond to a load for the microwave energy produced by the microwave power generation modules 250-252. The air cavity and the objects within the air cavity present an impedance to each microwave power generation module 250-252.

According to an embodiment, each microwave power generation module 250-252 includes an oscillator sub-system 260, frequency tuning circuitry 280, an impedance matching element 282, a resonant element 284, and bias circuitry 290. According to an embodiment, the oscillator sub-system 260 includes an input node 262, an output node 264, amplifier arrangement 270, and resonant circuitry 266. In addition, the oscillator sub-system 260 may include input impedance matching circuitry 268 and/or output impedance matching circuitry 269 coupled between transistor 272 and the input node 262 and/or the output node 264, respectively.

In an embodiment, oscillator sub-system 260 is a power microwave oscillator, in that the elements of the oscillator sub-system 260 are configured to produce an oscillating electrical signal at the output node 264 having a frequency in the microwave spectrum with a relatively high output power (e.g., an output power in a range of about 100 Watts (W) to about 200 W or more). Resonant circuitry 266, which is coupled along a feedback path between the output and input nodes 264, 262, completes a resonant feedback loop that causes the amplified electrical signals produced by the amplifier arrangement 270 to oscillate at or near the resonant frequency of the resonant circuitry 266. In an embodiment, the resonant circuitry 266 is configured to resonate at frequency in the microwave spectrum. According to a more particular embodiment, resonant circuitry 266 is configured to resonate at a frequency of about 2.45 GHz. Accordingly, amplified electrical signals produced by the amplifier arrangement 270 at the output node 264 oscillate at or near 2.45 GHz. It should be noted that, in practice, embodiments of the resonant circuitry 266 may be configured to resonate at different frequencies to suit the needs of the particular application utilizing the heating system 200. According to an embodiment, the resonant circuitry 266 includes a ring oscillator. In other embodiments, oscillator sub-system 260 may implement a type of resonator other than a ring oscillator (e.g., a mechanical or piezoelectric resonator or another type of resonator).

In the illustrated embodiment of FIG. 2, the amplifier arrangement 270 is implemented as a transistor 272 having an input terminal (or control terminal) coupled to an amplifier input node 274 and an output terminal coupled to an amplifier output node 275. In the illustrated embodiment, the transistor 272 includes a field effect transistor (FET) having a gate terminal connected to the amplifier input node 274, a drain terminal connected to the amplifier output node 275, and a source terminal connected to a node 278 configured to receive a ground reference voltage (e.g., about 0 Volts, although the ground reference voltage may be higher or lower than 0 Volts, in some embodiments). Although FIG. 2 illustrates the source terminal being coupled directly to ground, one or more intervening electrical components may be coupled between the source terminal and ground. In an embodiment, the transistor 272 includes a laterally diffused metal oxide semiconductor FET (LDMOSFET). However, it should be noted that the transistor 272 is not intended to be limited to any particular semiconductor technology, and in other embodiments, the transistor 272 may be realized as a gallium nitride (GaN) transistor, another type of MOSFET, a bipolar junction transistor (BJT), or a transistor utilizing another semiconductor technology.

In FIG. 2, amplifier arrangement 270 is depicted to include a single transistor 272 coupled in a particular manner to other circuit components. In other embodiments, amplifier arrangement 270 may include other amplifier topologies and/or the amplifier arrangement 270 may include multiple transistors or various types of amplifiers. For example, amplifier arrangement 270 may include a single ended amplifier, a double ended amplifier, a push-pull amplifier, a Doherty amplifier, a Switch Mode Power Amplifier (SMPA), or another type of amplifier.

Frequency tuning circuitry 280 includes capacitive elements, inductive elements, and/or resistive elements that are configured to adjust the oscillating frequency of the oscillating electrical signals generated by the oscillator sub-system 260. In an exemplary embodiment, the frequency tuning circuitry 280 is coupled between the ground reference voltage node and the input node 262 of the oscillator sub-system 260.

According to an embodiment, the oscillator sub-system 260 also may include amplifier input impedance matching circuitry 268 coupled between the input node 262 of the oscillator sub-system 260 and the amplifier input 274. The impedance matching circuitry 268 is configured to match, at the resonant frequency of the resonant circuitry 266, the input impedance of the amplifier arrangement 270 (at the amplifier input node 274) to the impedance of the resonant circuitry 266 and the frequency tuning circuitry 280 (at node 262). Similarly, and according to an embodiment, the oscillator sub-system 260 may also include amplifier output impedance matching circuitry 269 coupled between the amplifier output 275 and the output node 264, where the output impedance matching circuitry 269 is configured to match, at the resonant frequency of the resonant circuitry 266, the output impedance of the amplifier arrangement 270 (at the amplifier output node 275) to the impedance of the resonant circuitry 266.

Heating cavity 240 and any load 242 (e.g., food, liquids, and so on) positioned in the heating cavity 240 present a cumulative load for the electromagnetic energy (or RF power) that is radiated into the cavity 240 by the microwave power generation module(s) 250-252 (e.g., with different locations within the cavity 240 corresponding to different peak electric field magnitudes). More specifically, the cavity 240 and the load 242 present an impedance to the system, referred to herein as a "cavity input impedance." The cavity input impedance changes during a heating operation as the temperature of the load 242 increases.

Bias circuitry 290 is coupled between the amplifier arrangement 270 and a node 254 configured to receive a positive (or supply) voltage (e.g., from power supply 230). In an embodiment, the voltage difference between the supply voltage at node 254 and the ground voltage node 278 is less than about 50 Volts. In other embodiments, the voltage difference may be more than 50 Volts. According to an embodiment, bias circuitry 290 is configured to control the direct current (DC) or nominal bias voltages at the gate and drain terminals of the transistor 272, in order to turn the transistor 272 on and to maintain the transistor 272 operating in the active mode during operation of the oscillator sub-system 260. In this regard, the bias circuitry 290 is coupled to the gate terminal of the transistor 272 of the amplifier arrangement 270 at the amplifier input node 274 and the drain terminal of the transistor 272 at the amplifier output node 275. In accordance an embodiment, bias circuitry 290 includes a temperature sensor 292 and temperature compensation circuitry 294 configured to sense or otherwise detect the temperature of the transistor 272 and to adjust the gate bias voltage at the amplifier input node 274 in response to increases and/or decreases in the temperature of the transistor 272 or the amplifier arrangement 270. In such an embodiment, bias circuitry 290 may be configured to maintain substantially constant quiescent current for the transistor 272 in response to temperature variations.

In addition, in an embodiment, bias circuitry 290 may include power detection circuitry 296. Power detection circuitry 296 is coupled between the output node 264 of the oscillator sub-system 260 and the distal end of the resonant element 284 (e.g., power detection circuitry 296 may be coupled to the output node 264, to impedance matching element 282, or to the resonant element 284, in various embodiments). Power detection circuitry 296 is configured to monitor, measure, or otherwise detect the power of the oscillating signals provided at the output node 264. In an embodiment, power detection circuitry 296 also is configured to monitor or otherwise measure the power of signal reflections from the resonant element 284. In response to detecting that the power of the signal reflections exceeds a threshold value, power detection circuitry 296 may cause bias circuitry 290 to turn off or otherwise disable amplifier arrangement 270. In this manner, power detection circuitry 296 and bias circuitry 290 are cooperatively configured to protect amplifier arrangement 270 from signal reflections in response to changes in the impedance at the resonant element 284.

Impedance matching element 282 is coupled between the output node 264 of oscillator sub-system 260 and resonant element 284, and resonant element 284 is coupled to impedance matching element 282. Impedance matching element 282 is configured to perform an impedance transformation from an impedance of the oscillator sub-system 260 (or the amplifier arrangement 270 or transistor 272) to an intermediate impedance, and resonant element 284 is configured to perform a further impedance transformation from the intermediate impedance to an impedance of heating cavity 240 (or the air cavity defined by heating cavity 240). In other words, the combination of impedance matching element 282 and resonant element 284 is configured to perform an impedance transformation from an impedance of the oscillator sub-system 260 (or the amplifier arrangement 270 or transistor 272) to an impedance of heating cavity 240 (or the air cavity defined by heating cavity 240).

Resonant element 284 is configured to radiate microwave energy into the heating cavity 240. More specifically, resonant element 284 includes one or more antennas, waveguides, and/or other hardware components configured to translate the oscillating electrical signals at the oscillator output node 264 to electromagnetic microwave signals at the resonant frequency of resonant circuitry 266. For example, in a heating system application where the resonant circuitry 266 is configured to produce signals at a resonant frequency of 2.45 GHz, resonant element 284 translates the oscillating electrical signals at the oscillator output node 264 to microwave electromagnetic signals at 2.45 GHz and directs the microwave signals into the heating cavity 240 of the heating system 200. Resonant element 284 may include, for example, a dipole antenna, a patch antenna, a microstrip antenna, a slot antenna, or another type of antenna that is suitable for radiating microwave energy.

FIG. 2 illustrates a heating system 200 that includes multiple microwave power generation modules 250-252. As indicated previously, other embodiments of heating systems may include as few as one microwave power generation module, or may include more than three microwave power generation modules. When the heating system includes multiple microwave power generation modules, the microwave power generation modules may be identically configured (e.g., they may resonate at the same frequency, radiate microwave energy at the same power level, and so on), and may be operated simultaneously or in a defined sequence. Alternatively, the microwave power generation modules may be configured differently (e.g., they may resonate at different frequencies, and or may radiate microwave energy at different power levels). In such alternate embodiments, the microwave power generation modules may be operated simultaneously or in a defined sequence.

During operation of the system 200, the ratio of electric field to magnetic field in the heating cavity 240 is separated by the impedance of the cavity medium. In some embodiments, the microwave energy may be launched into the cavity 240 with voltage driven antennas in order to generate a high electric field, since dielectric heating is directly proportional. During operation, a first, voltage-type of re-radiator 276-1 may be positioned in a region of high electric field, and energy received by the first re-radiator 276-1 may be fed through a transmission path to a second, voltage-type of re-radiator 276-2 that is positioned in an area of low electric field. The second re-radiator 276-2 may then radiate the received energy into the area of low electric field. However, in other embodiments, a current-type of re-radiator 276-1 may be positioned in a high magnetic field position, and energy received by the current-type of re-radiator 276-1 may be fed through a transmission path to a voltage-type of re-radiator 276-2 that is positioned in an area of low electric field. Again, the voltage-type of re-radiator 276-2 may then radiate the received energy into the area of low electric field. In either embodiment, the first re-radiator 276-1 plus the transmission path acts as a passive repeater, which essentially moves power from one area of the cavity 240 (i.e., the area in which the first re-radiator 276-1 is located) to another area of the cavity 240 (i.e., the area in which the second re-radiator 276-2 is located) in order to match into new mode conditions.

The re-radiators 276 essentially include passive antennas, in an embodiment. Voltage-types of re-radiators 276 may include, but are not limited to, dipole antennas, monopole antennas, patch antennas, and combinations or variations thereof, while current-types of re-radiators 276 may include, but are not limited to, loop antennas, hairpin antennas, and combinations or variations thereof, for example. While only two re-radiators 276-1 and 276-2 are shown, it should be understood that re-radiators 276 may include a 1D or 2D array of or a non-uniform arrangement of two or more passive radiators. The re-radiators 276-1 and 276-2 may be selectively placed at positions at (e.g., on or proximate to) a wall of the heating cavity 240.

In an embodiment, the re-radiators 276-1 and 276-2 may be placed at locations within the heating cavity 240 that are expected to correspond (e.g., based on characterization of the system 200) to a higher than average peak electric field magnitude (or magnetic field magnitude) and a lower than average peak electric field magnitude, respectively, when RF energy is supplied in the heating cavity 240 (e.g., by the microwave power generation module(s) 250-252). A "transmission path" between the re-radiators 276-1, 276-2 can include a conductive transmission line that may be configured to selectively electrically connect and electrically disconnect the re-radiators 276-1, 276-2. The transmission path may include one or more switches, for example, and the re-radiators 276-1 and 276-2 may be selectively connected together (i.e., via the closing of a switch coupled between the re-radiator 276-1 and the re-radiator 276-2 by the system controller 210) so that a portion of the electromagnetic energy absorbed by one re-radiator 276-1 may be transferred through the closed switch and emitted by a second re-radiator 276-2, thus raising the peak electric field magnitude in the proximity of the second re-radiator 276-2 and effectively redistributing the electric field in the heating cavity 240. By redistributing the electric field in the heating cavity 240 in this way, the load 242 may be heated more evenly.

The transmission path also may include a phase shifter, which may also be selectively coupled between the re-radiator 276-1 and the re-radiator 276-2. A switch coupled in series with the phase shifter may be opened or closed to selectively shift the phase of signals passed between the re-radiator 276-1 and the re-radiator 276-2. The phase shifter may be a fixed phase shifter that is configured to provide a predetermined amount of phase shift, or the phase shifter may be a variable phase shifter that provides an amount of phase shift corresponding to commands received from the system controller 210.

In an embodiment, each of the re-radiators 276-1 and 276-2 may be selectively "detuned", or removed from operation, for example, by connecting the re-radiator 276-1, 276-2 to ground. For example, a first switch may be coupled between the re-radiator 276-1 and ground, and a second switch may be coupled between the re-radiator 276-2 and ground. Closing the first switch may short the re-radiator 276-1 to ground, effectively deactivating the re-radiator 276-1 by disabling its ability to re-radiate. Closing the second switch may short the re-radiator 276-2 to ground, effectively deactivating the re-radiator 276-2 by disabling its ability to re-radiate.

In an embodiment, the re-radiators 276 may be arranged in a programmable 1D or 2D array, with each of the re-radiators 276 being selectively connectable to ground (e.g., via switches coupled between the re-radiators 276 and ground, where the switches may be controlled by the system controller 210). In this manner, the re-radiators 276 may be selectively enabled (i.e., configured to re-radiate) and disabled (i.e., configured not to re-radiate), and may be selectively connectable to each other re-radiator of the 1D or 2D array of re-radiators 276 (e.g., via switches coupled between any given pair of the re-radiators 276 that may be controlled by the system controller 210) so that the electric field within the heating cavity 240 may be selectively redistributed. In some embodiments, a variable phase shifter may also be included in series with the switch between each given pair of the re-radiators 276, or as a separate switchable connection between each given pair of the re-radiators 276, so that the phase of signals emitted by the re-radiators 276 may be selectively controlled (e.g., by the system controller 210). By selectively enabling and disabling connections between the re-radiators 276 themselves and between the re-radiators 276 and ground, the array of re-radiators 276 may be customized to provide electric field redistribution and/or random scattering of the electric field of a variety of heating cavities having varied electromagnetic characteristics.

In some embodiments, the electromagnetic field characteristics of the cavity 240 could be determined in the factory (e.g., to determine areas of the cavity in which higher-than-average and lower-than-average electromagnetic fields typically are present during operation), and the re-radiators 276 could be positioned in such higher-than-average and lower-than-average electromagnetic field areas. Further, the system controller 210 could be programmed to selectively connect and disconnect sets of re-radiators 276 based on this pre-characterization of the electromagnetic field characteristics of the cavity 240. In addition or alternatively, system 200 may include one or more sensing devices 298 (e.g., optical cameras, infrared cameras, and so on) disposed in the cavity 240, and the sensing devices 298 may sense or infer the electric and/or magnetic field distribution in the cavity 240 during operation and provide signals to the system controller 210 indicating the sensed field distribution. Based on the signals, the system controller 210 can dynamically control connectivity between sets of re-radiators 276 to facilitate transfer of energy from areas of high electric or magnetic fields to areas of low electric fields, as previously described.

Figure 3:
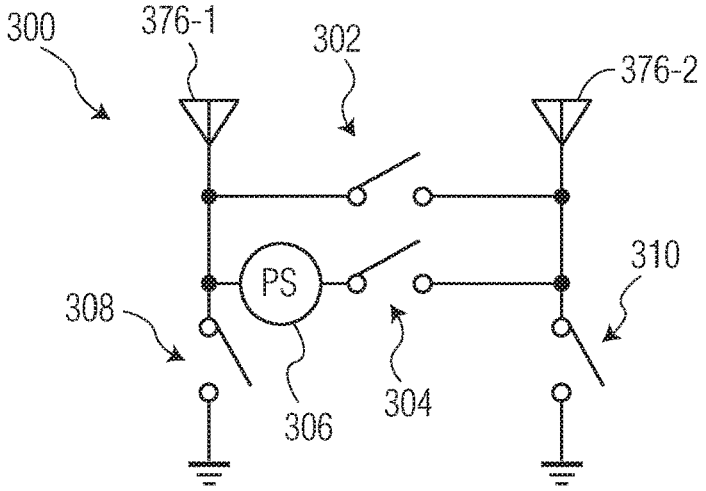
FIG. 3 is a block diagram of a switching circuitry coupled to two re-radiators.

FIG. 3 shows an illustrative circuit 300 for a pair of re-radiators 376-1 and 376-2 (e.g., re-radiators 176, 276, FIGS. 1, 2) and switchable connections (e.g., transmission paths) from the pair of re-radiators 376-1 and 376-2 to each other and to ground. It should be understood that the re-radiators 376-1 and 376-2 may represent any two re-radiators of a larger array of re-radiators, and is not limited to only adjacent pairs of re-radiators or only 2×1 arrays of re-radiators. The re-radiators 376-1 and 376-2 may be disposed at first and second locations at (e.g., on or proximate to) one or more interior walls of a heating cavity (e.g., heating cavity 240, FIG. 2) of a heating system (e.g., heating systems 100, 200, FIGS. 1, 2). When active (e.g., when not selectively shorted to ground) each re-radiator 376-1, 376-2 may absorb or re-emit electromagnetic energy in the heating cavity at the first and second locations, respectively. For example, the electromagnetic energy absorbed by a re-radiator 376-1, 376-2 may be from an electric field generated in the cavity by applying RF energy in the form of an RF signal to one or more microwave power generation modules (e.g., by the microwave power generation module(s) 250-252, FIG. 2) of the heating system with source resonant element (e.g., resonant element 284, FIG. 2).

The circuit 300 may include the pair of re-radiators 376-1 and 376-2, and one or more transmission paths coupled between the re-radiators 376-1, 376-2. A first transmission path may selectively enable a direct connection between the re-radiators 376-1, 376-2 without a phase shift, and a second transmission path may selectively enable a direct connection between the re-radiators 376-1, 376-2 with a phase shift. Only one of the first or the second transmission path would be controlled to connect the re-radiators 376-1, 376-2 at any given time. In alternate embodiments, the circuit 300 may include only one of the first or second transmission paths.

Circuit 300 further includes switches 302, 304, 308, and 310, and a phase shifter 306. The switches 302, 304, 308, and 310 may include electric and/or mechanical switches such as transistors or relays, for example. The phase shifter 306 may be fixed (e.g., providing a predetermined amount of phase shift) or variable (e.g., providing a variable amount of phase shift). The switches 302, 304, 308, and 310 and the phase shifter 306 may be coupled to and controlled by a system controller (e.g., system controller 210, FIG. 2). For example, the system controller may control the state of the switches 302, 304, 308, 310 (e.g., open or closed), and may select the amount of phase shift provided by the phase shifter 306, when the phase shifter 306 is a variable phase shifter.

Along the first transmission path, switch 302 is electrically coupled between the re-radiator 376-1 and the re-radiator 376-2 (e.g., without intervening components). Closing the switch 302 electrically connects the re-radiator 376-1 to the re-radiator 376-2, so that electromagnetic energy absorbed by either or both of the re-radiators 376-1 and 376-2 is distributed between both of the re-radiators 376-1 and 376-2.

For example, while excitation energy is applied to the microwave generation module, an electric field is generated in the cavity with a first magnitude at the re-radiator 376-1 (i.e., at the first location) and a second magnitude at the re-radiator 376-2 (i.e., at the second location). When the switch 302 is closed while the RF energy is being applied, the resultant electromagnetic energy absorbed by the re-radiators 376-1 and 376-2 is redistributed between the re-radiators 376-1, 376-2. If the first magnitude is greater than the second magnitude, for example, the energy redistributed from the first re-radiator 376-1 to the second re-radiator 376-2 caused by closing the switch 302 is re-radiated by the second re-radiator 376-2, which may cause the magnitude of the electric field at the second location to increase to a third magnitude, where the third magnitude is greater than the second magnitude.

Along the second transmission path, the switch 304 and the phase shifter 306 (PS) are electrically coupled in series between the re-radiator 376-1 and the re-radiator 376-2 (e.g., in parallel with the switch 302). Closing the switch 304 connects the re-radiator 376-1 to the re-radiator 376-2 through the phase shifter 306, so that electromagnetic energy absorbed by each of the re-radiators 376-1 and 376-2 is phase shifted and distributed between both of the re-radiators 376-1 and 376-2.

The switch 308 is electrically coupled between the re-radiator 376-1 and ground. Closing the switch 308 shorts the re-radiator 376-1 to ground, preventing the re-radiator 376-1 from effectively re-resonating, effectively disabling the re-radiator 376-1. The switch 310 is electrically coupled between the re-radiator 376-2 and ground. Closing the switch 310 shorts the re-radiator 376-2 to ground, preventing the re-radiator 376-2 from effectively re-resonating, effectively disabling the re-radiator 376-2.

Figure 4:
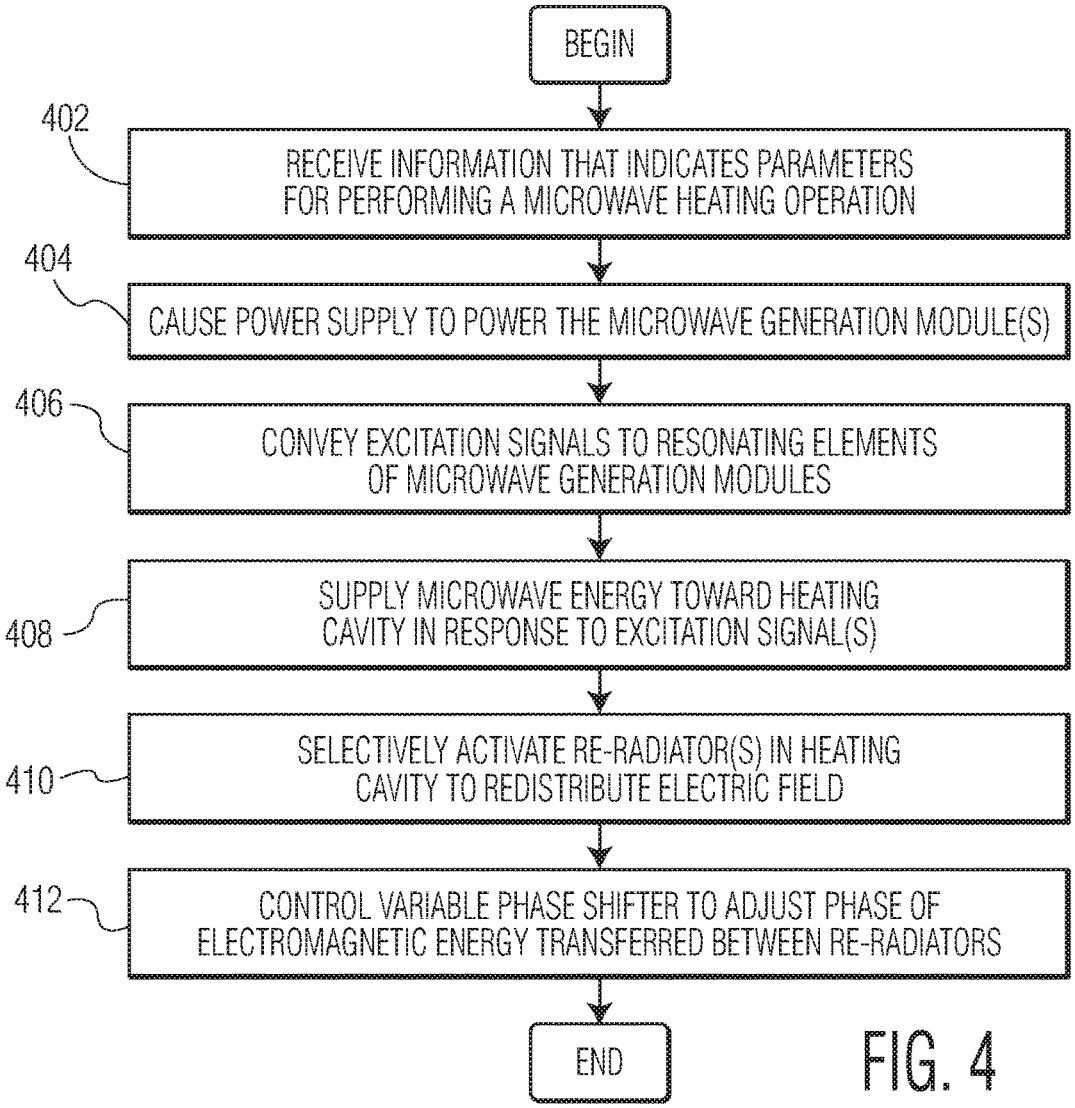
FIG. 4 is a flowchart of a method of operating a heating system that includes one or more microwave generation modules, in accordance with an example embodiment.

Now that embodiments of the electrical and physical aspects of heating systems have been described, various embodiments of methods for operating such heating systems will be described in conjunction with FIG. 4. More specifically, FIG. 4 is a flowchart of a method of operating a heating system (e.g., system 100, 200, FIGS. 1, 2) with one or more microwave generation modules (e.g., microwave generation modules 250, 251, 252, FIG. 2) and a plurality of re-radiators (e.g., re-radiators 176, 276-1, 276-2, 376-1, 376-2, FIGS. 1-3), in accordance with an example embodiment.

The method may begin, in block 402, when the system controller (e.g., system controller 210, FIG. 2) receives information that indicates parameters for performing a microwave heating operation, and that indicates that the microwave heating operation should start. For example, the information indicating the parameters may be derived from user inputs provided through a user interface (e.g., of the control panel 120, FIG. 1; user interface 220, FIG. 2) of the system. The information may convey the duration of a heating operation, and the power level of the heating operation, for example.

According to various embodiments, the system controller optionally may receive additional inputs indicating the load type (e.g., meats, liquids, or other materials) and/or the load weight. For example, information regarding the load type may be received from the user through interaction with the user interface (e.g., by the user selecting from a list of recognized load types). Alternatively, the system may be configured to scan a barcode visible on the exterior of the load, or to receive an electronic signal from an RFID device on or embedded within the load. Information regarding the load weight may be received from the user through interaction with the user interface, or from a weight sensor of the system. As indicated above, receipt of inputs indicating the load type and/or load weight is optional, and the system alternatively may not receive some or all of these inputs.

The start indication may be received, for example, after a user has place a load (e.g., load 242, FIG. 2) into the system's heating cavity (e.g., heating cavity 240, FIG. 2), has sealed the heating cavity (e.g., by closing the door), and has pressed a start button (e.g., of the control panel 120, FIG. 1; user interface 220, FIG. 2). In an embodiment, sealing of the cavity may engage one or more safety interlock mechanisms, which when engaged, indicate that microwave energy supplied to the heating cavity will not substantially leak into the environment outside of the cavity. Disengagement of a safety interlock mechanism may cause the system controller immediately to pause or terminate the heating operation.

In block 404, the system controller causes a power supply (e.g., power supply 230, FIG. 2) to provide power to one or more microwave generation modules (e.g., microwave generation modules 250, 251, 252, FIG. 2) in a way that will cause the microwave generation module(s) to produce one or more excitation signals that are consistent with the parameters specified for the heating operation.

In block 406, the excitation signal(s) may be conveyed to respective resonant element(s) (e.g., resonant element 284, FIG. 2) of the microwave generation module(s). For example, the excitation signals may be oscillating electrical signals produced by a resonant circuit (e.g., resonant circuit 266, FIG. 2) at a predetermined resonant frequency (e.g., 2.45 GHz)

In block 408, the resonant element(s) may supply microwave energy into the heating cavity in response to the excitation signal(s). For example, the resonant element(s) may convert oscillating electrical signals received from the resonant circuitry into microwave electromagnetic signals at 2.45 GHz, and direct these signals into the heating cavity.

In block 410, the system controller may selectively activate (or deactivate) one or more re-radiators (e.g., re-radiators 176, 276, 376-1, 376-2, 576-1, 576-2, 676-1, 676-2, 676-3, 676-4, FIGS. 1, 2, 3, 5A-C, 6A, 6B) disposed in the heating cavity. For example, the system controller may activate or deactivate the re-radiators by controlling one or more switches (e.g., switches 308, 310, FIG. 3) coupled between the re-radiators and ground. In addition, in some embodiments, the system controller may electrically connect sets of re-radiators by controlling one or more other switches (e.g., switches 302, 304, 508, 608-1, 608-2, FIGS. 3, 5A-5C, 6A, 6B) coupled between re-radiators, such that electromagnetic energy absorbed by a first re-radiator may be transferred to a second re-radiator through transmission paths that include the activated switches. For example, if higher magnitude electromagnetic energy is initially present in the region of the first re-radiator compared to the electromagnetic energy in the region of the second re-radiator, a portion of the electromagnetic energy at the first re-radiator may be transferred to and emitted by the second re-radiator through one of the activated switches along the transmission paths, thus decreasing the disparity in magnitude of the electromagnetic energy in the two regions and effectively redistributing the electric field in the heating cavity.

In block 412, for embodiments of the heating system that include a variable phase shifter (e.g., phase shifter 306, FIG. 3) coupled along the transmission path between two of the re-radiators, the system controller may selectively control the magnitude of phase shift applied by the variable phase shifter to electrical signals being transferred between the two re-radiators. For example, the system controller may selectively control the phase shifter to apply phase shifts in a range of zero degrees to 180 degrees, according to some embodiments. The resonant element(s) may continue to supply the microwave energy until provision of the excitation signal is discontinued, at which point the method ends.

Figure 5A:
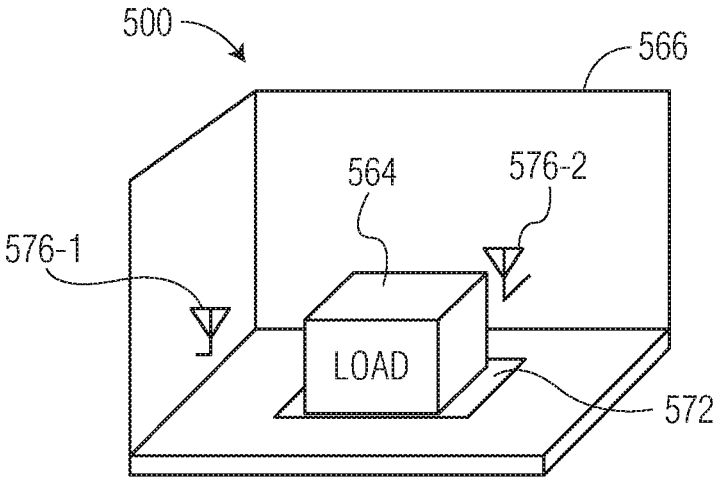
FIG. 5A is a simplified perspective view inside a heating cavity of a heating appliance having re-radiators, in accordance with an example embodiment.

FIG. 5A shows a perspective view of the interior of a heating cavity 566 (e.g., heating cavity 240, FIG. 2) of a heating system 500 (e.g., heating system 100, 200, FIGS. 1, 2). The heating cavity 566 includes first and second re-radiators 576-1 and 576-2 disposed at (e.g., on or proximate to) different walls of the heating cavity 566 (although re-radiators 576-1 and 576-2 could be disposed on the same wall, as well). A load 564 (e.g., load 242, FIG. 2) is disposed over a region 572 on the bottom wall of the heating cavity. During heating operations performed by the system 500, RF energy (e.g., microwave energy) is supplied into the heating cavity 566 by one or more microwave generation modules (not shown; e.g., microwave generation modules 250, 251, 252, FIG. 2) and, as a result, an electric field may be created in the heating cavity 566. The magnitudes of this electric field at various locations is affected by the mode of propagation currently supported in the cavity 566, and the distance of a given location from resonant element(s) of the microwave generation module(s) that are supplying microwave energy into the cavity. Electric field magnitude may initially (e.g., prior to activation of the re-radiators 576-1 and 576-2) be unevenly distributed throughout the cavity (e.g., due to the mode of propagation and non-idealities intrinsic to the heating cavity 566).

Figure 5B:
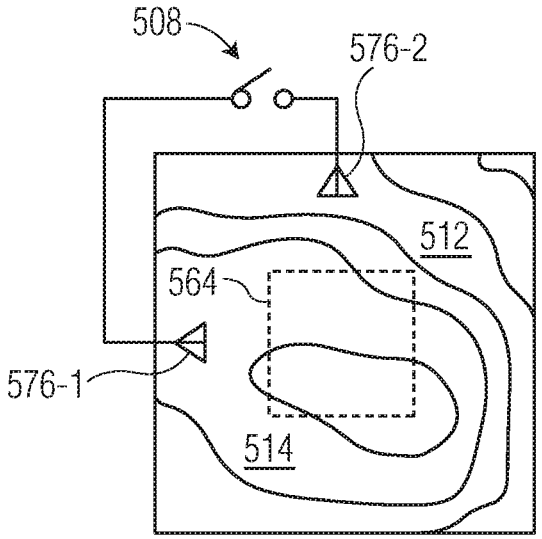
FIG. 5B is a top-down view inside the heating cavity along a plane intersecting the re-radiators and a load showing peak electric field magnitudes of different regions while the re-radiators are disconnected from one another, in accordance with an example embodiment.

FIG. 5B shows a top-down view of the system 500 along a plane that intersects the first and second re-radiators 576-1, 576-2 (e.g., re-radiators 176, 276, 376-1, 376-2, FIGS. 1-3), and the load 564. A switch 508 (e.g., switch 302, FIG. 3) may be coupled between the first re-radiator 576-1 and the second re-radiator 576-2. The switch 508 may be controlled by a system controller (e.g., system controller 210, FIG. 2) of the heating system 500 to be open in the present example, thus electrically isolating the first re-radiator 576-1 from the second re-radiator 576-2. Different regions within the heating cavity 566 are shown to be delineated based on peak electric field magnitude within those regions. For example, while a given amount of excitation energy is supplied to resonant element(s) of the microwave generation module(s), the region 512 may have a first, relatively low electric field intensity (e.g., an average peak electric field magnitude of around 60 V/m), while region 514 may have a second, relatively high electric field intensity (e.g., an average peak electric field magnitude of around 120 V/m).

Figure 5C:
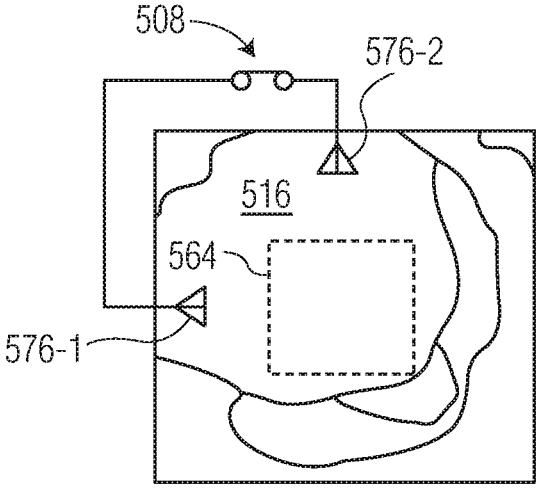
FIG. 5C is a top-down view inside the heating cavity along a plane intersecting the re-radiators and a load showing peak electric field magnitudes of different regions while the re-radiators are connected to one another, in accordance with an example embodiment.

When the switch 508 is closed, electromagnetic energy in at least the region 514 is absorbed by the first re-radiator 576-1, transferred through the transmission path that includes switch 508 to the second re-radiator 576-2, and emitted into the region 512 by the second re-radiator 576-2. The resultant redistribution of the electric field is shown in FIG. 5C. A new region 516 results from the redistribution of the electric field and may have an average peak electric field magnitude that is greater than that of former region 512. This field may or may not be less than that of former region 514. For example, the region 516 may have an average peak electric field magnitude of around 90 V/m.

Figure 6A:
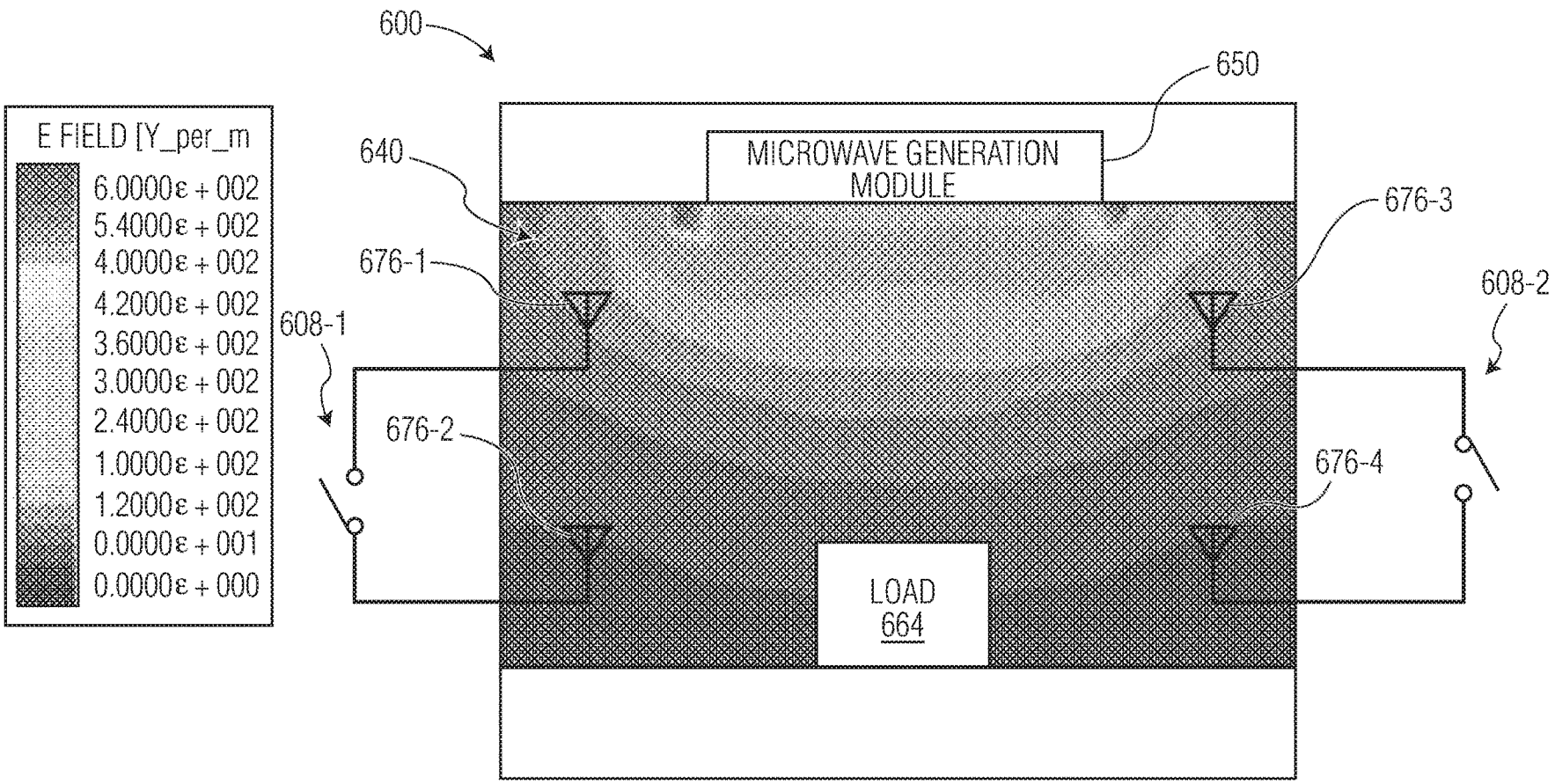
FIG. 6A is a cross-sectional side-view inside a heating cavity of a heating system having re-radiators showing electric field magnitude of different regions while the re-radiators are disconnected from one another, in accordance with an example embodiment.
Figure 6B:
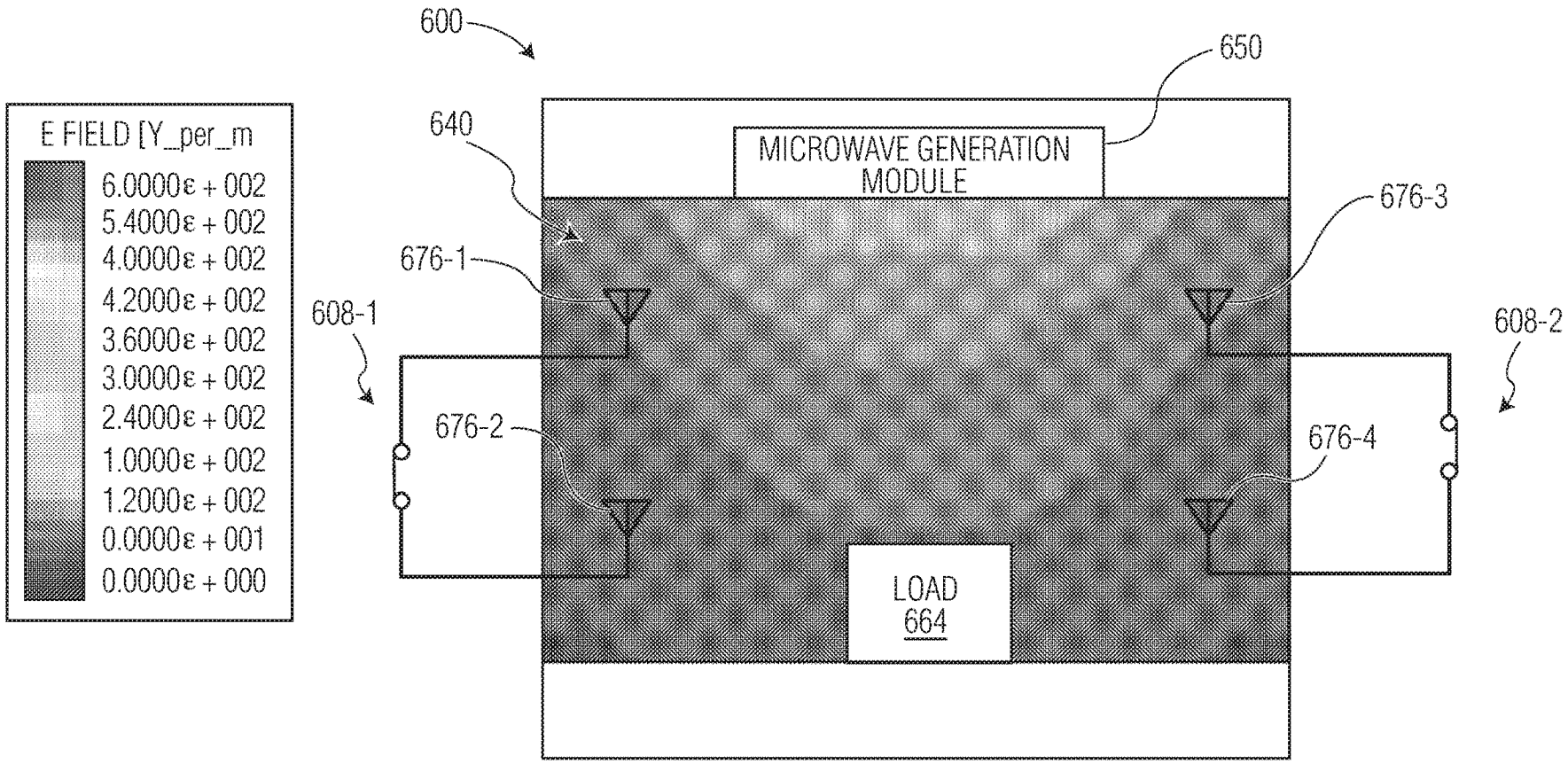
FIG. 6B is a cross-sectional side-view inside the heating cavity of the heating system showing electric field magnitude of different regions while pairs of the re-radiators are connected to one another, in accordance with an example embodiment.

FIGS. 6A and 6B show cross-sectional side-views of a heating system 600 (e.g., heating system 100, 200, FIGS. 1, 2), which includes a heating cavity 640 (e.g., heating cavity 240, FIG. 2), microwave generation module 650 (e.g., microwave generation modules 250, 251, 252, FIG. 2), re-radiators 676-1, 676-2, 676-3, 676-4 (e.g., re-radiators 176, 276, 376-1, 376-2, 576-1, 576-2, FIGS. 1, 2, 3, 5A, 5B, 5C), a first switch 608-1 (e.g., switch 302, 508, FIGS. 3, 5) that controllably connects or disconnects the re-radiator 676-1 and the re-radiator 676-2 based on instructions received from a system controller (not shown; e.g., system controller 210, FIG. 2), a second switch 608-2 (e.g., switch 302, 508, FIGS. 3, 5) that controllably connects or disconnects the re-radiator 676-3 and the re-radiator 676-4 based on instructions received from the system controller, and a load 664 positioned in the heating cavity. Microwave energy supplied to by a resonant element (e.g., resonant element 284, FIG. 2) of the microwave generation module causes an uneven electric field to be created in the heating cavity 640. The average peak magnitudes of the electric field at different locations within the cavity are differentially shaded in the present example.

In the example shown in FIG. 6A, the average peak electric field magnitude proximate to the re-radiators 676-1 and 676-3 is roughly three-times greater than the average peak electric field magnitude proximate to the re-radiators 676-2 and 676-4 while the switches 608-1 and 608-2 are open. For example, the average peak electric field magnitude proximate to the re-radiators 676-1 and 676-3 may be about 180 V/m, whereas the average peak electric field magnitude proximate to the re-radiators 676-2 and 676-4 may be about 30 V/M. When the switches 608-1 and 608-2 are closed, as shown in FIG. 6B, the electric field in the cavity is redistributed as electromagnetic energy proximate to and absorbed by the re-radiator 676-1 is passed to and emitted by the re-radiator 676-2, and electromagnetic energy proximate to and absorbed by the re-radiator 676-3 is passed to and emitted by the re-radiator 676-4. For example, the average peak electric field magnitude at the re-radiators 676-1 and 676-3 may be lowered to about 120 V/m and the average peak electric field magnitude at the re-radiators 676-2 and 676-4 may be increased to about 60 V/m.

The connecting lines shown in the various figures contained herein are intended to represent exemplary functional relationships and/or physical couplings between the various elements. It should be noted that many alternative or additional functional relationships or physical connections may be present in an embodiment of the subject matter. In addition, certain terminology may also be used herein for the purpose of reference only, and thus are not intended to be limiting, and the terms "first", "second" and other such numerical terms referring to structures do not imply a sequence or order unless clearly indicated by the context.

As used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common node).

The foregoing description refers to elements or nodes or features being "connected" or "coupled" together. As used herein, unless expressly stated otherwise, "connected" means that one element is directly joined to (or directly communicates with) another element, and not necessarily mechanically. Likewise, unless expressly stated otherwise, "coupled" means that one element is directly or indirectly joined to (or directly or indirectly communicates with) another element, and not necessarily mechanically. Thus, although the schematic shown in the figures depict one exemplary arrangement of elements, additional intervening elements, devices, features, or components may be present in an embodiment of the depicted subject matter.

In an example embodiment, a thermal increase system may be coupled to a heating cavity for containing a load. The thermal increase system may include a microwave generation module, a first re-radiator, a second re-radiator, a first transmission path, and a controller. The microwave generation module may be configured to supply radio frequency (RF) energy to the heating cavity, such that an electric field is created in the heating cavity. The first re-radiator may be disposed in the heating cavity at a first location. The second re-radiator may be disposed in the heating cavity at a second location. The first transmission path may include a first switch coupled between the first re-radiator and the second re-radiator. The controller may be configured to control the first switch.

In some embodiments, when the first switch is closed by the controller while the RF energy is supplied, the first re-radiator may absorb electromagnetic energy at the first location and transfer the electromagnetic energy to the second re-radiator through the first transmission path, and the second re-radiator may emit the electromagnetic energy at the second location to redistribute the electric field.

In some embodiments, when the first switch is opened by the controller, the first re-radiator may be electrically isolated from the second re-radiator.

In some embodiments, the thermal increase system may further include a second switch coupled between the first re-radiator and ground, and a third switch coupled between the second re-radiator and ground. The controller may be configured to control the second switch to selectively short the first re-radiator to ground, and control the third switch to selectively short the second re-radiator to ground.

In some embodiments, the thermal increase system may further include a phase shifter that is connected in series with the first switch along the first transmission path.

In some embodiments, the thermal increase system may further include a second transmission path including a fourth switch coupled between the first re-radiator and the second re-radiator in parallel with the first transmission path.

In some embodiments, the first re-radiator may include a passive antenna selected from a dipole antenna, a monopole antenna, a patch antenna, a loop antenna, and a hairpin antenna.

In some embodiments, the first re-radiator and the second re-radiator may be voltage-type re-radiators, each comprising a passive antenna selected from a dipole antenna, a monopole antenna, a patch antenna, a loop antenna, and a hairpin antenna.

In some embodiments, the first re-radiator is a current-type re-radiator comprising a passive antenna selected from a loop antenna and a hairpin antenna, and the second re-radiator may be a voltage-type re-radiator comprising a passive antenna selected from a dipole antenna, a monopole antenna, and a patch antenna.

In an example embodiment, a thermal increase system may include a heating cavity, a microwave generation module, an array of re-radiators, a first switch, a second switch, and a controller. The microwave generation module may be configured to supply microwave energy to the heating cavity, creating an electric field in the heating cavity. The array of re-radiators may include at least a first re-radiator disposed in the heating cavity at a first location and a second re-radiator disposed in the cavity at a second location. The first switch may be coupled between the first re-radiator and ground. The second switch may be coupled between the second re-radiator and ground. The controller may be configured to control the first switch and the second switch.

In some embodiments, the thermal increase system may further include a first transmission path including a third switch that electrically connects the first re-radiator to the second re-radiator when closed, wherein controller is configured to control the third switch.

In some embodiments, when the third switch is closed by the controller and the microwave energy is supplied, the first re-radiator may absorb first electromagnetic energy at the first location and transfer the first electromagnetic energy through the first transmission path to the second re-radiator, and the second re-radiator may emit the first electromagnetic energy at the second location to redistribute the electric field.

In some embodiments, the thermal increase system may include a phase shifter coupled in series with the third switch along the first transmission path.

In some embodiments, the phase shifter may include a variable phase shifter, and wherein the controller is configured to select an amount of phase shift provided by the variable phase shifter.

In some embodiments, the array of re-radiators may include an array of passive antennas selected from dipole antennas, monopole antennas, patch antennas, loop antennas, and hairpin antennas.

In an example embodiment, a method of operating a thermal increase system may include steps of radiating, by a microwave generation module that is disposed proximal to a heating cavity, microwave energy into the heating cavity, and selectively connecting, by a controller, a first re-radiator disposed in the heating cavity at a first location to a second re-radiator disposed in the heating cavity at a second location to enable energy absorbed by the first re-radiator to be transferred to the second re-radiator for radiation of energy by the second re-radiator into the heating cavity.

In some embodiments, the method may further include a step of applying, by a phase shifter, a phase shift to the energy passed between the first re-radiator and the second re-radiator.

In some embodiments, the phase shifter may be a variable phase shifter, and the controller may control a magnitude of the phase shift applied by the variable phase shifter.

In some embodiments, the method may further include steps of selectively connecting, by the controller, the first re-radiator and ground, and selectively connecting, by the controller, the second re-radiator and ground.

In some embodiments, the first and second re-radiators may each include a passive antenna selected from a dipole antenna, a monopole antenna, a patch antenna, a loop antenna, and a hairpin antenna.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A thermal increase system coupled to a heating cavity for containing a load, the thermal increase system comprising:

a microwave generation module that supplies radio frequency (RF) energy to the heating cavity, such that an electric field is created in the heating cavity;

a first re-radiator disposed in the heating cavity at a first location;

a second re-radiator disposed in the heating cavity at a second location;

a first transmission path including a first switch coupled between the first re-radiator and the second re-radiator;

a controller that is configured to control the first switch;

a second switch coupled between the first re-radiator and ground; and a third switch coupled between the second re-radiator and ground, wherein the controller is configured to control the second switch to selectively short the first re-radiator to ground, and to control the third switch to selectively short the second re-radiator to ground.

2. The thermal increase system of claim 1, wherein, when the first switch is closed by the controller while the RF energy is supplied, the first re-radiator absorbs electromagnetic energy at the first location and transfers the electromagnetic energy to the second re-radiator through the first transmission path, and the second re-radiator emits the electromagnetic energy at the second location to redistribute the electric field.

3. The thermal increase system of claim 2, wherein, when the first switch is opened by the controller, the first re-radiator is electrically isolated from the second re-radiator.

4. The thermal increase system of claim 1, further comprising:

a phase shifter that is connected in series with the first switch along the first transmission path.

5. The thermal increase system of claim 1, wherein the first re-radiator comprises a passive antenna selected from the group consisting of: a dipole antenna, a monopole antenna, a patch antenna, a loop antenna, and a hairpin antenna.

6. The thermal increase system of claim 1, wherein the first re-radiator and the second re-radiator are voltage-type re-radiators, each comprising a passive antenna selected from the group consisting of: a dipole antenna, a monopole antenna, a patch antenna, a loop antenna, and a hairpin antenna.

7. The thermal increase system of claim 1, wherein:

the first re-radiator is a current-type re-radiator comprising a passive antenna selected from the group consisting of: a loop antenna and a hairpin antenna; and the second re-radiator is a voltage-type re-radiator comprising a passive antenna selected from the group consisting of: a dipole antenna, a monopole antenna, and a patch antenna.

8. A thermal increase system coupled to a heating cavity for containing a load, the thermal increase system comprising:

a microwave generation module that supplies radio frequency (RF) energy to the heating cavity, such that an electric field is created in the heating cavity;

a first re-radiator disposed in the heating cavity at a first location;

a second re-radiator disposed in the heating cavity at a second location;

a first transmission path including a first switch coupled between the first re-radiator and the second re-radiator;

a controller that is configured to control the first switch;

a phase shifter that is connected in series with the first switch along the first transmission path; and a second transmission path including a fourth switch coupled between the first re-radiator and the second re-radiator in parallel with the first transmission path.

9. A thermal increase system comprising:

a heating cavity;

a microwave generation module that supplies microwave energy to the heating cavity, creating an electric field in the heating cavity;

an array of re-radiators that includes at least a first re-radiator disposed in the heating cavity at a first location and a second re-radiator disposed in the cavity at a second location;

a first switch coupled between the first re-radiator and ground;

a second switch coupled between the second re-radiator and ground; and a controller configured to control the first switch and the second switch.

10. The thermal increase system of claim 9, further comprising:

a first transmission path including a third switch that electrically connects the first re-radiator to the second re-radiator when closed, wherein controller is configured to control the third switch.

11. The thermal increase system of claim 10, wherein, when the third switch is closed by the controller and the microwave energy is supplied, the first re-radiator absorbs first electromagnetic energy at the first location and transfers the first electromagnetic energy through the first transmission path to the second re-radiator, and the second re-radiator emits the first electromagnetic energy at the second location to redistribute the electric field.

12. The thermal increase system of claim 10, further comprising:

a phase shifter coupled in series with the third switch along the first transmission path.

13. The thermal increase system of claim 12, wherein the phase shifter comprises a variable phase shifter, and wherein the controller is configured to select an amount of phase shift provided by the variable phase shifter.

14. The thermal increase of claim 9, wherein the array of re-radiators comprises an array of passive antennas selected from the group consisting of: dipole antennas, monopole antennas, patch antennas, loop antennas, and hairpin antennas.

* * * * *